US011783989B2

(12) United States Patent
Kim et al.

(10) Patent No.: US 11,783,989 B2
(45) Date of Patent: Oct. 10, 2023

(54) TRANSFORMER

(71) Applicants: SOLUM CO., LTD., Gyeonggi-do (KR); ATUM CO., LTD., Seoul (KR)

(72) Inventors: Eun Sik Kim, Gyeonggi-do (KR); Jun Kyu Lee, Gyeonggi-do (KR); Changyong Kwon, Gyeonggi-do (KR); Dong-kyun Ryu, Seoul (KR); Sang-keun Ji, Gyeonggi-do (KR); Taeksoo Han, Seoul (KR); Jung Soo Lee, Gyeonggi-do (KR)

(73) Assignees: SOLUM CO., LTD., Gyeonggi-do (KR); ATUM CO., LTD., Seoul (KR)

( * ) Notice: Subject to any disclaimer, the term of this patent is extended or adjusted under 35 U.S.C. 154(b) by 925 days.

(21) Appl. No.: 16/697,914

(22) Filed: Nov. 27, 2019

(65) Prior Publication Data

US 2020/0357564 A1 Nov. 12, 2020

(30) Foreign Application Priority Data

May 9, 2019 (KR) ..... 10-2019-0054099

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 27/30*** | (2006.01) |
| ***H01F 27/32*** | (2006.01) |
| *H01F 27/24* | (2006.01) |

(52) U.S. Cl.

CPC ..... *H01F 27/2804* (2013.01); *H01F 27/29* (2013.01); *H01F 27/306* (2013.01); *H01F 27/32* (2013.01); *H01F 27/24* (2013.01); *H01F 2027/2809* (2013.01)

(58) Field of Classification Search

CPC ..... H01F 27/2804
USPC ..... 336/200
See application file for complete search history.

(56) References Cited

U.S. PATENT DOCUMENTS

| | | | | |
|---|---|---|---|---|
| 2004/0108929 | A1* | 6/2004 | Ichikawa | H01F 27/2823 336/83 |
| 2008/0231403 | A1* | 9/2008 | Hsu | H01F 27/2804 336/200 |
| 2016/0225514 | A1* | 8/2016 | Cheng | H01F 27/2866 |
| 2017/0032888 | A1* | 2/2017 | Park | H01F 27/325 |

FOREIGN PATENT DOCUMENTS

| | | |
|---|---|---|
| KR | 101579427 | 12/2015 |
| KR | 20160041837 | 4/2016 |

* cited by examiner

*Primary Examiner* — Ronald Hinson
(74) *Attorney, Agent, or Firm* — IPLA P.A.

(57) ABSTRACT

A transformer includes: an upper primary substrate (110) which is formed by stacking a plurality of dielectric substrates, each substrate being provided with spiral conductive patterns; a lower secondary substrate (120) which is formed by stacking a plurality of dielectric substrates, each substrate being provided with spiral conductive patterns, in which the lower secondary substrate is positioned below the upper primary substrate (110) in such a way that the lower secondary substrate comes into contact with the upper primary substrate (110) or is spaced apart from the upper primary substrate (110); and a secondary coil element (200) of a planar shape to produce an induced current by a current applied to the upper primary substrate (110) and the lower primary substrate (120).

8 Claims, 5 Drawing Sheets

TRANSFORMER

CROSS REFERENCE

This application claims priority from Korean Patent Application No. 10-2019-0054099, filed on May 9, 2019, which is hereby incorporated by reference for all purposes as if fully set forth therein.

BACKGROUND

The present invention relates to a transformer, and more particularly, to a planar transformer for use in a charger or an adaptor.

In general, a transformer includes a primary coil which services as an input terminal, and a secondary coil which services as an output terminal.

One example of the transformers is disclosed by Korean Patent No. 10-1579427, published on Dec. 22, 2015, which proposes a compact transformer for use in a charger for a mobile phone.

The transformer of the related art includes upper and lower primary substrates of a printed circuit board type, the upper and lower primary substrates being manufactured by patterning a conductive material on dielectric surfaces thereof.

The upper and lower primary substrates of the printed circuit board type are manufactured by coating the dielectric board with copper film, and etching the substrates to form a coil circuit pattern thereon.

However, the transformer of the related art has a problem in that since the upper and lower primary substrates are interposed between two secondary coil elements, magnetic field leakage occurs, and the efficiency of the transformer from the primary coils to the secondary coil is lowered. Also, there is another problem in that since the secondary coil elements are separated in a vertical direction, the entire height of the transformer is increased.

Since the primary coils of the printed circuit board type are formed by patterning a certain circuit on the printed circuit board, a manufacturing period is extended, and thus it is inappropriate for a short delivery date. Also, since the primary coils of the printed circuit board type are basically patterned on the printed circuit board, it is difficult to cope with diversification of design (product tuning).

In the case where the number of turns of the circuit patterns is increased, layers are increased, and thus the thickness of the printed circuit board becomes thick, which results in the increased volume of the primary coils. Also, the price of the printed circuit board is raised to increase a cost of the product.

PATENT LITERATURES

Patent Document 1: Korean Patent Document No.: 10-1579427 (published on Dec. 22, 2015)

Patent Document 2: Korean Laid-Open Patent Document No.: 10-2016-0041837 (published on Apr. 18, 2016)

SUMMARY OF THE INVENTION

Therefore, the present invention has been made in view of the above problems, and the first object of the present invention is to provide a transformer including a primary substrate which is divided into an upper primary substrate and a lower primary substrate, thereby increasing an interface area between the upper and lower primary substrate and a secondary coil element which results in decreased magnetic field leakage and improved efficiency.

The second object of the present invention is to provide a transformer including upper and lower primary substrates and a secondary coil element which are alternatively arranged (in a zigzag pattern), thereby remarkably decreasing magnetic field leakage and thus improving efficiency from the upper and lower primary substrates to the secondary coil element.

The third object of the present invention is to provide a transformer including a secondary coil element which is interposed between two upper and lower primary substrates, thereby reducing occurrence of magnetic field leakage and thus improving efficiency from the primary substrates to the secondary coil element.

The fourth object of the present invention is to provide a transformer including two coupling portions which are bent in the U-shape, thereby further shortening a distance between upper and lower primary substrates and a secondary coil element.

The fifth object of the present invention is to provide a transformer including upper and lower primary substrates which are electrically connected in series with each other by a configuration of coupling pins made of a metal material, thereby easily and reliably connecting two spaced upper and lower primary substrates.

In order to achieve the above and other objects of the present invention, according to one aspect of the present invention, there is provided a transformer including: an upper primary substrate which is formed by stacking a plurality of dielectric substrates, each substrate being provided with spiral conductive patterns; a lower primary substrate which is formed by stacking a plurality of dielectric substrates, each substrate being provided with spiral conductive patterns, in which the lower primary substrate is positioned below the upper primary substrate in such a way that the lower primary substrate comes into contact with the upper primary substrate or is spaced apart from the upper primary substrate; and a secondary coil element of a planar shape to produce an induced current by a current applied to the upper primary substrate and the lower primary substrate.

With the above configuration, the transformer of the present invention has some advantages as follows:

First, the primary substrate is divided into the upper primary substrate and the lower primary substrate, thereby increasing an interface area between the upper and lower primary substrate and the secondary coil element which results in decreased magnetic field leakage and improved efficiency.

Second, the upper and lower primary substrates and the secondary coil element are alternatively arranged (in a zigzag pattern), thereby remarkably decreasing the magnetic field leakage and thus improving the efficiency from the upper and lower primary substrates to the secondary coil element.

Third, the secondary coil element is interposed between two upper and lower primary substrates, thereby reducing occurrence of the magnetic field leakage and thus improving the efficiency from the primary substrates to the secondary coil element.

Fourth, two coupling portions are bent in the U-shape, thereby further shortening a distance between the upper and lower primary substrates and the secondary coil element.

Lastly, the upper and lower primary substrates are electrically connected in series with each other by the configuration of the coupling pins made of the metal material, thereby easily and reliably connecting two spaced upper and lower primary substrates.

DETAILED DESCRIPTION OF THE PREFERRED EMBODIMENT

Figure 1:
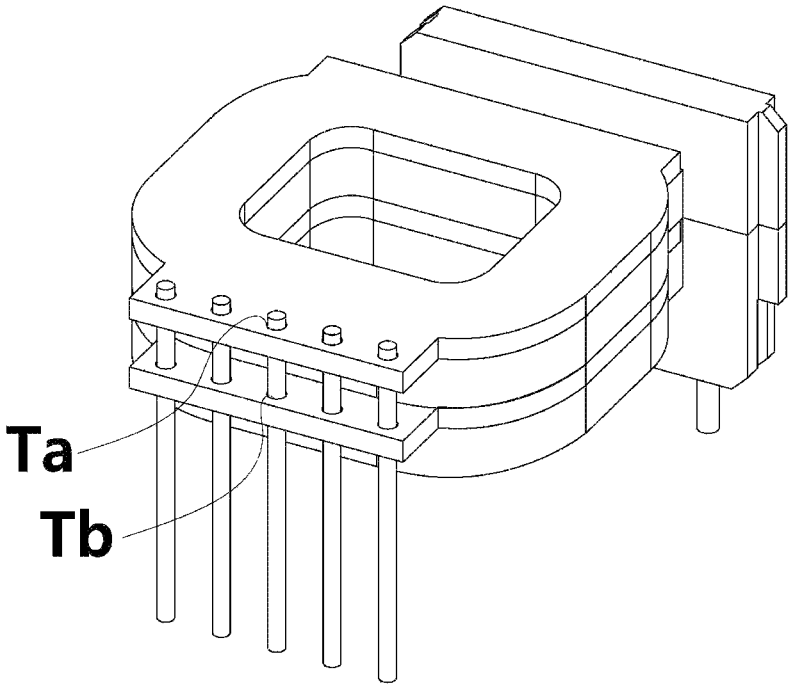
FIG. 1 is a front perspective view illustrating a transformer according to the first embodiment of the present invention.
Figure 2:
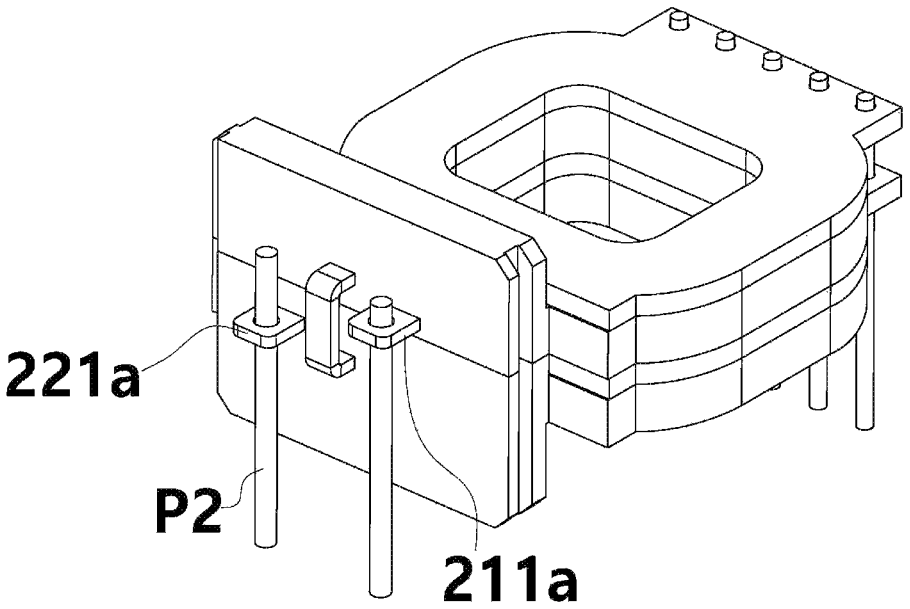
FIG. 2 is a rear perspective view of the transformer in FIG. 1.
Figure 3:
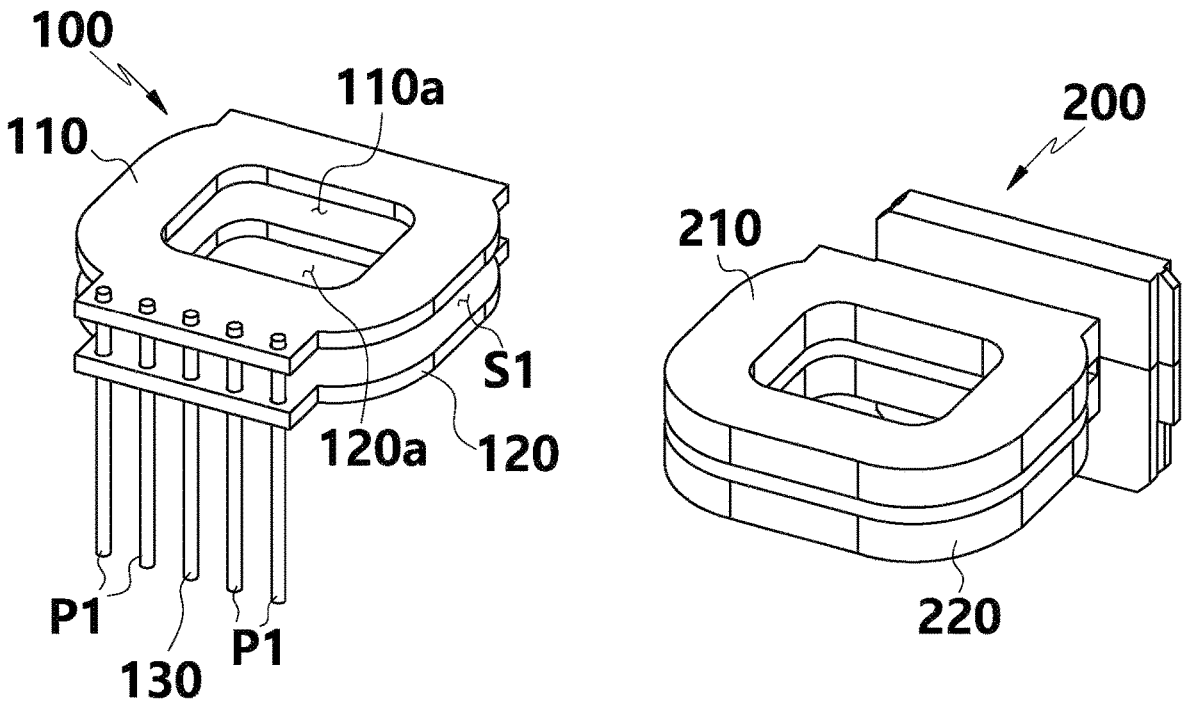
FIG. 3 is an exploded perspective view illustrating upper and lower primary substrates and a secondary coil element of the transformer in FIG. 1.
Figure 4:
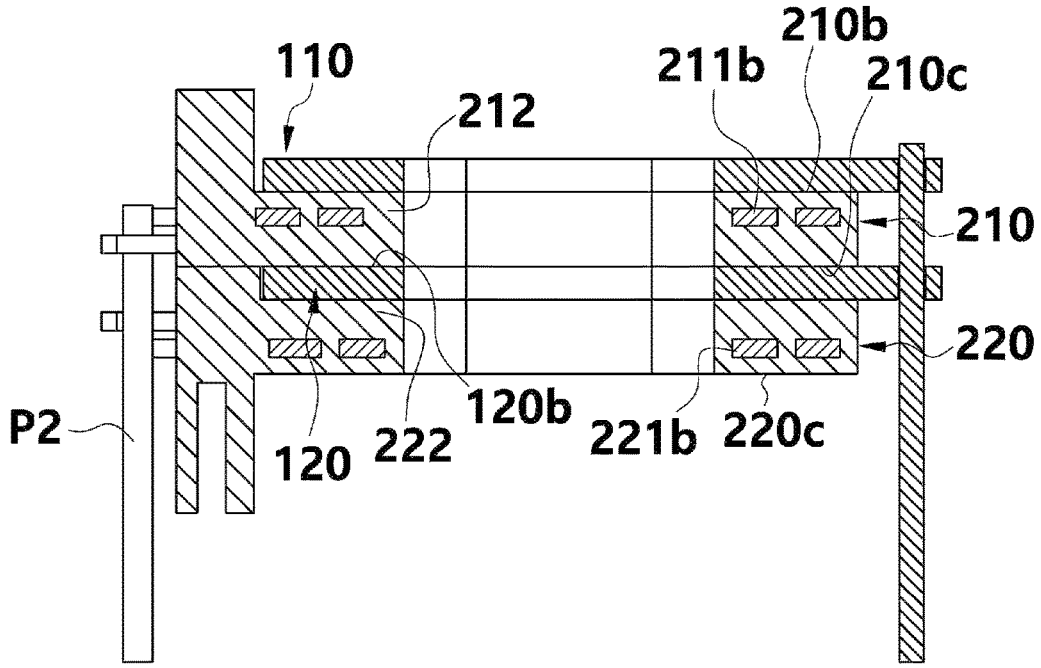
FIG. 4 is a cross-sectional view of the transformer in FIG. 1 which is taken in a longitudinal direction.

A transformer according to preferred embodiments of the present invention will now be described in detail with reference to the accompanying drawings.

A transformer of the present invention is configured to be mounted on a main printed circuit board of a charger or an adaptor.

Also, the transformer of the present invention is formed in a planar shape.

The transformer according to the first embodiment of the present invention is characterized by including an upper primary substrate 110 which is formed by stacking a plurality of dielectric substrates, each substrate being provided with spiral conductive patterns; a lower primary substrate 120 which is formed by stacking a plurality of dielectric substrates, each substrate being provided with spiral conductive patterns, in which the lower primary substrate is positioned below the upper primary substrate 110 in such a way that the lower primary substrate comes into contact with the upper primary substrate 110 or is spaced apart from the upper primary substrate 110; and a secondary coil element 200 of a planar shape to produce an induced current by a current applied to the upper primary substrate 110 and the lower primary substrate 120.

The configuration including the upper primary substrate 110 and the lower primary substrate 120 is referred to as a primary substrate 100.

The upper primary substrate 110 and the lower primary substrate 120 are multilayered printed circuit boards (MLB) which are formed by stacking a plurality of dielectric substrates (not illustrated), each substrate being provided with a spiral conductive pattern of a metal material.

The upper primary substrate 110 and the lower primary substrate 120 are provided at a center thereof with a first center opening 110*a* and a second opening 120*a*, respectively, to receive a magnetic core therein.

The upper primary substrate 110 and the lower primary substrate 120 are electrically connected in series with each other. As compared with the case where the primary coils are connected in parallel to each other, therefore, the number of windings is reduced to shorten the height of a product (i.e., a transformer) and thus reduce the size of the product.

A plurality (e.g., four) of primary connector pins P1 are coupled to the upper primary substrate 110 and the lower primary substrate 120, and are electrically connected to a main printed circuit board (not illustrated) of a finished product (e.g., a charger or an adaptor), onto which the transformer is mounted, to supply the current.

The transformer according to the first embodiment of the present invention is characterized in that the upper primary substrate 110 and the lower primary substrate 120 are electrically connected in series with each other by conductive metallic coupling pins 130 which are coupled to a via terminal Ta of the upper primary substrate 110 and a via terminal Tb of the lower primary substrate 120.

Therefore, the series connection between the upper primary substrate 110 and the lower primary substrate 120 can be easily achieved by the simple configuration.

Figure 8:
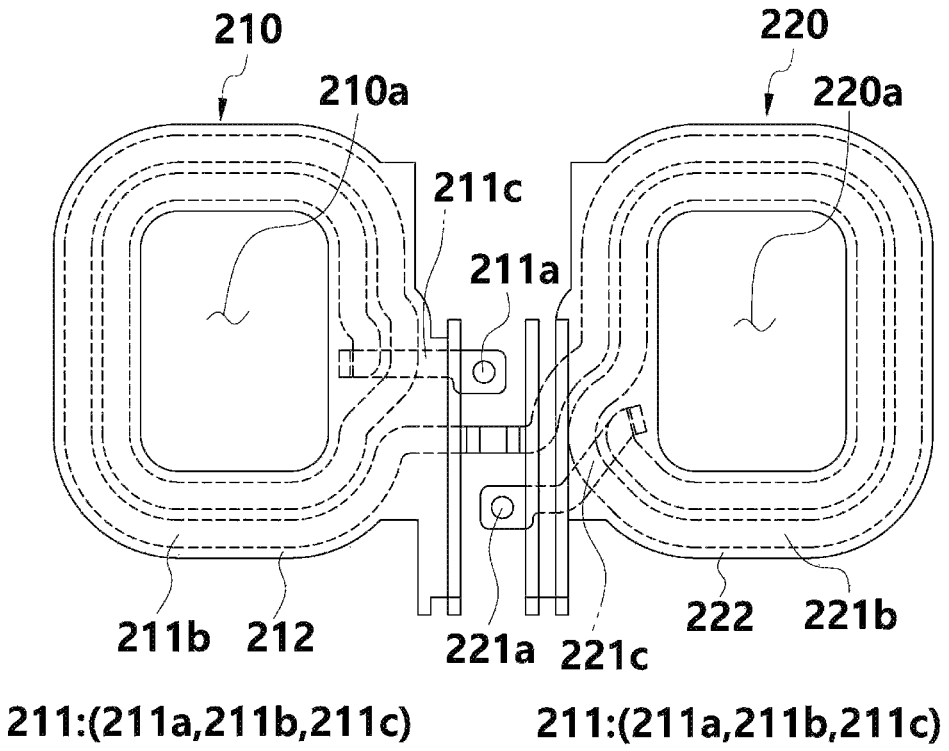
FIG. 8 is a plan view illustrating a state in which a first coil body and a second coil body of the secondary coil element are opened.
Figure 9:
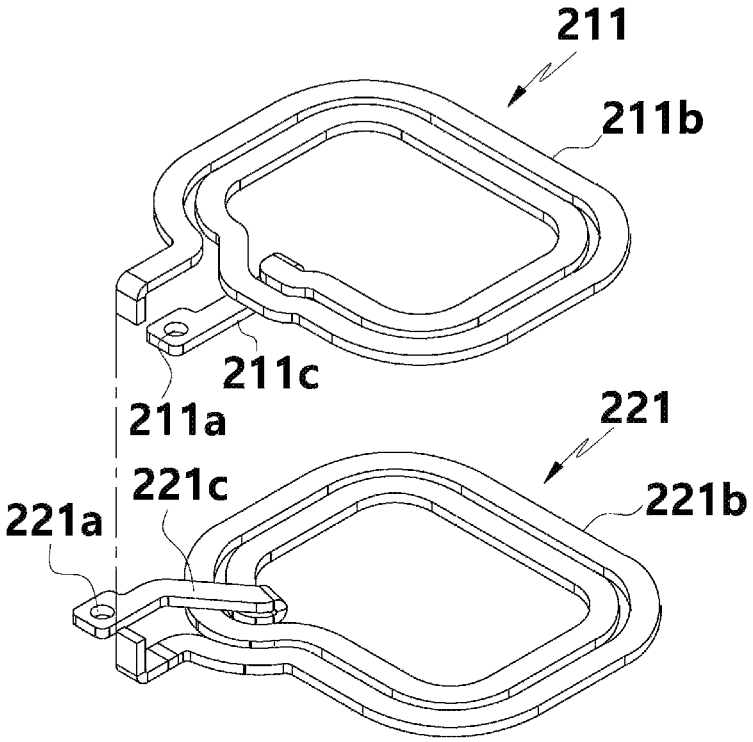
FIG. 9 is a perspective view illustrating the first coil and the second coil of the secondary coil element.

In the transformer according to the first embodiment of the present invention, the secondary coil element 200 is preferably made in such a way that insulation members 212 and 222 are formed by introducing a molding resin into an injection mold (not illustrated) in a state in which the secondary coils 211 and 221 are placed in a cavity (not illustrated) of the injection molding, and the secondary coils 211 and 221 are embedded by insert molding, as illustrated in FIGS. 8 and 9.

The secondary coils 211 and 221 include coil pattern portions 211*b* and 221*b* which are formed in the shape of a planar spiral pattern, coupling portions 211*c* and 221*c* which are bent in a U-shape from each end of the coil pattern portions 211*b* and 221*b*, and terminals 211*a* and 221*a* formed at each end of the coupling portions 211*c* and 221*c*. The coupling portions 211*c* and 221*c* are bent in the U-shape in such a way that each end of the coil patterns 211*b* and 221*b* are inwardly bent, and then are rearwardly bent toward the terminal, and a top surface 210*b* and a bottom surface 220*c* of the secondary coil element 200 are formed in a flat shape with no protrusion.

Since the coupling portions 211*c* and 221*c* are bent in the U-shape, and the top surface 210*b* and the bottom surface 220*c* of the secondary coil element 200 are formed in the flat shape with no protrusion, the primary coil elements 110 and 120 come into surface contact with the secondary coil element 200, so that a distance between the primary coil elements 110 and 120 and the secondary coil element 200 is significantly reduced to improve a magnetic coupling force and shorten the height of the product.

The insulation members 212 and 222 are configured to house the coils 211 and 221 of the secondary coil element, except for the terminals 211*a* and 221*a*.

The secondary coil element 200 includes a first coil body 210 and a second coil body 220 disposed below the first coil body 210 and spaced apart from the first coil body. The configuration of the first coil body 210 and the second coil body 220 will now be described in detail.

The first coil body 210 has the first coil 211 having the first coil pattern portion 211*b* which is formed in the shape of a planar spiral pattern, the first coupling portion 211*c* which is formed in a U-shape by bending one end of the first coil pattern portion 211*b* and then bending the end in a rearward direction, and the first terminal 211*a* formed at the end of the first coupling portion 211*c*, and the first insulation member 212 having a first center opening 210*a* formed at a center and made of a synthetic resin to house the first coil 211 therein, except for the first terminal 211*a*.

The second coil body 220 has the second coil 221 having the second coil pattern portion 221*b* which is formed in the shape of a planar spiral pattern, the second coupling portion 221*c* which is formed in a U-shape by bending one end of the second coil pattern portion 221*b* and then bending the end in a rearward direction, and the second terminal 221*a* formed at one end of the second coupling portion 221*c*, and the second insulation member 222 having a second center opening 220*a* formed at a center and made of a synthetic resin to house the second coil 221 therein, except for the second terminal 221*a*.

The first coupling portion 211*c* and the second coupling portion 221*c* which are bent in a rearward direction are bent in the U-shape so as not to overlap with each other. Therefore, it is possible to reduce the thickness of the secondary coil element 200.

Hereinafter, the configuration and operation of the transformer according to the first embodiment of the present invention will be described with reference to FIGS. 1 to 4.

As illustrated in FIGS. 1 to 4, the transformer according to the first embodiment of the present invention is characterized in that the primary coil element and the secondary coil element are disposed in a zigzag pattern.

In the transformer according to the first embodiment of the present invention, the lower primary substrate 120 is positioned below the upper primary substrate 110, and is spaced apart from each other to form a receiving space S1 between the upper and lower primary substrates 110 and 120. The secondary coil element 200 includes the first coil body 210 and the second coil body 220 spaced apart from the first coil body 210. Any one of the first coil body 210 and the second coil body 220 of the secondary coil element 200 is inserted into the receiving space S1, and the upper and lower primary substrates 110 and 120 and the secondary coil element 200 are alternatively (zigzag) arranged in the vertical direction.

The expression "alternatively arranged" means that any one of the upper and lower primary substrates 110 and 120 is interposed between the first coil body 210 and the second coil body 220 which are opposite to each other, and the other is disposed on the top surface of the first coil body 210 or the bottom surface of the second coil body 220.

For example, the upper primary substrate 110, the first coil body 210, the lower primary substrate 120 and the second coil body 220 are arranged in order from top to bottom (see FIGS. 1 to 4), or the first coil body 210, the upper primary substrate 110, the second coil body 220 and the lower primary substrate 120 may be arranged in order from top to bottom.

By the configuration in which the upper and lower primary substrates 110 and 120 and the secondary coil element 200 are alternatively arranged in the vertical direction, occurrence of magnetic field leakage is significantly decreased, which remarkably improves the efficiency of the transformer from the primary substrates to the secondary coil element.

As described in the description of the related art, if the primary coil element is interposed between the upper and lower secondary coil element, the primary coil comes into contact with two surfaces of the secondary coil element (the secondary coil elements has four surfaces in total, i.e., two surfaces of the upper secondary coil element and two surfaces of the lower secondary coil element, but one bottom surface of the upper secondary coil element and one top surface of the lower secondary coil element come into contact the primary coil). As described above, if the primary coil element and the secondary coil element are disposed in the zigzag pattern, the primary coil element comes into contact with three surfaces.

Specifically, the primary coil element comes into contact with two surface between the upper and lower secondary coil element, as the related art, and one surface of the primary coil element further comes into contact with the outer surface of the upper or lower secondary coil element, so that the primary coil element comes into contact with three surfaces of the secondary coil element in total.

With the contact of three surfaces, an interface area between the primary coil element and the secondary coil element is increased to significantly decrease the magnetic field leakage and thus improve the efficiency.

In the transformer according to the first embodiment of the present invention, the first coupling portion 211*c* is bent in the U-shape in such a way that one end of the first coil pattern 211*b* is inwardly (downwardly) bent, and then is rearwardly bent, and the second coupling portion 221*c* is bent in the U-shape in such a way that one end of the second coil pattern 221*b* is inwardly (upwardly) bent, and then is rearwardly bent.

Alternatively, the first coupling portion 211*c* and the second coupling portion 221*c* may be bent in the U-shape in the same direction, i.e., all the first and second coupling portions may be bent in the upward direction or the downward direction, and then be bent in a rearward direction.

With the structure in which the primary coil element and the secondary coil element are disposed in the zigzag pattern, the first coupling portion 211*c* and the second coupling portion 221*c* can be manufactured so as not to overlap with each other, thereby reducing the height thereof as much as possible.

Now, the configuration and operation of a transformer according to the second embodiment of the present invention will be described with reference to FIGS. 5 to 7.

Figure 5:
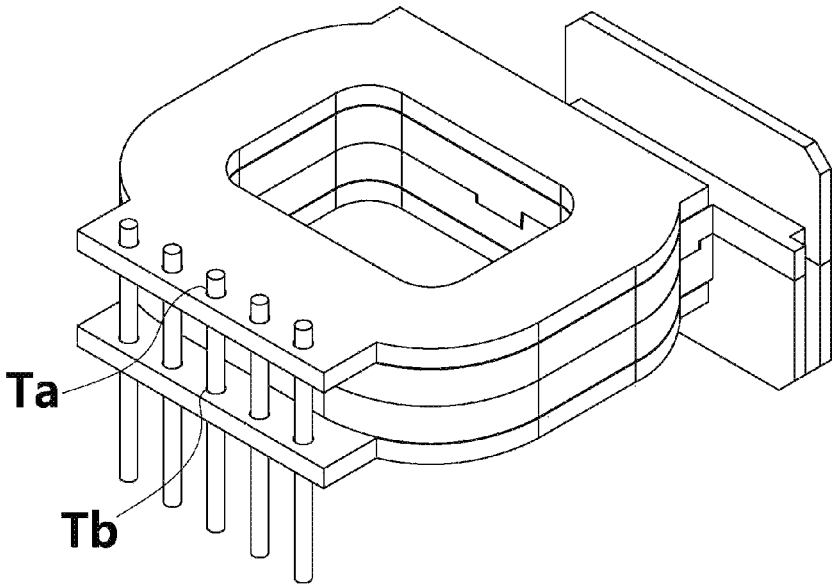
FIG. 5 is a front perspective view illustrating a transformer according to the second embodiment of the present invention.
Figure 6:
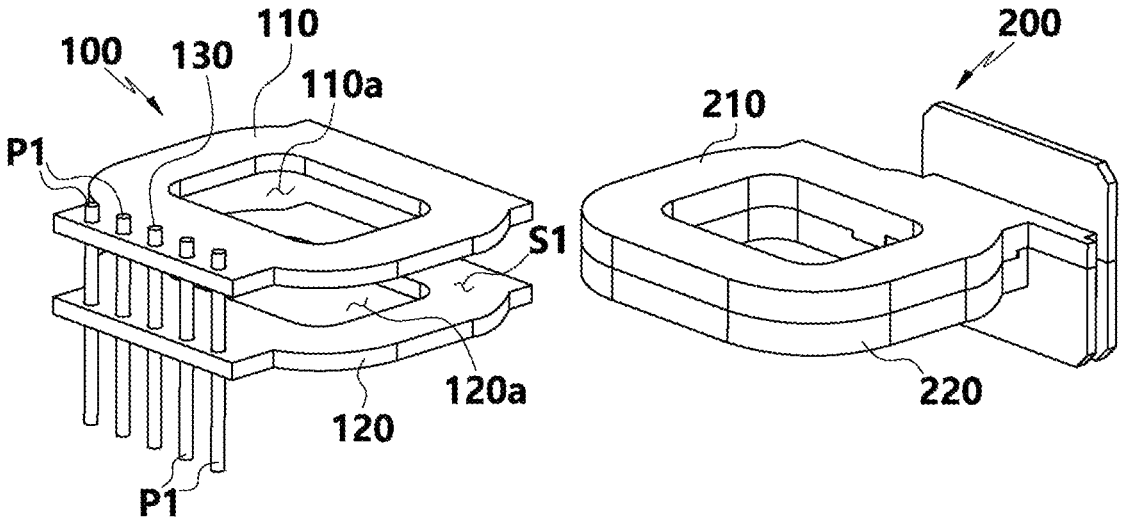
FIG. 6 is an exploded perspective view illustrating upper and lower primary substrates and a secondary coil element of the transformer in FIG. 5.
Figure 7:
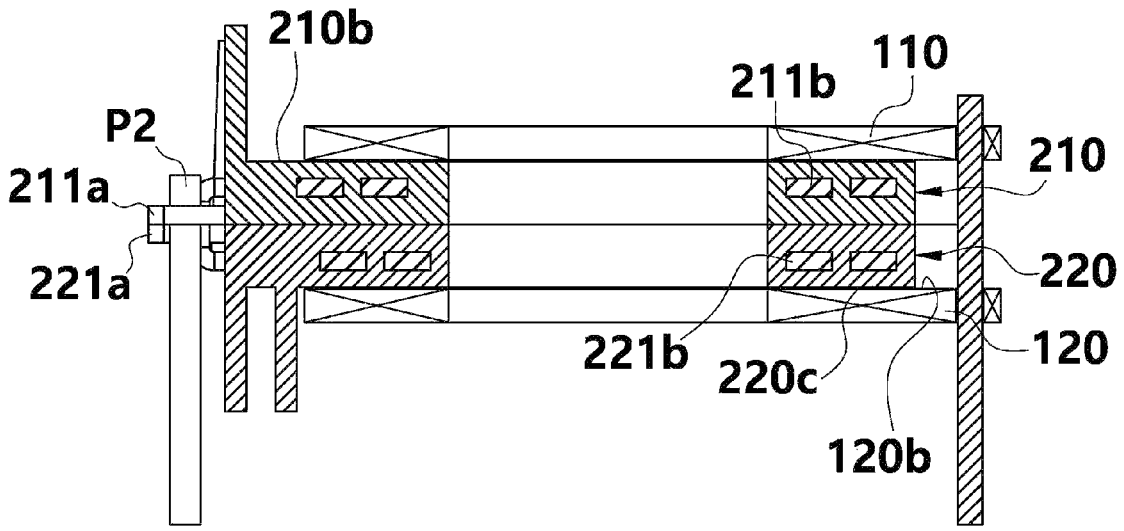
FIG. 7 is a cross-sectional view of the transformer in FIG. 5 which is taken in a longitudinal direction.

As illustrated in FIGS. 5 to 7, the transformer according to the second embodiment of the present invention is characterized in that a secondary coil element is interposed between upper and lower primary substrates.

In the transformer according to the second embodiment of the present invention, a lower primary substrate 120 is positioned below an upper primary substrate 110, and is spaced apart from each other to form a receiving space S1 between the upper and lower primary substrates 110 and 120. A secondary coil element 200 is inserted in the receiving space S1 formed between the upper and lower primary substrates 110 and 120.

With the configuration in which the secondary coil element 200 is interposed between the upper and lower primary substrates 110 and 120, the magnetic field leakage is decreased to improve the efficiency from the primary substrates to the secondary coil element, as compared with the related art in which one primary coil element is interposed between two secondary coil elements.

In the transformer according to the second embodiment of the present invention, the secondary coil element 200 may include one secondary coil body 210 or one secondary coil body 220, or two secondary coil bodies 210 and 220. This configuration is determined depending upon design specification related to the output of the transformer, and also belongs to a technical scope of the present invention. Also, three or more secondary coil bodies 210 and 220 may be provided according to design specification, and also belongs to the technical scope of the present invention.

The transformer according to the second embodiment of the present invention will now be described in detail, based on the case where two secondary coil elements 200 are provided.

A bottom surface 220*c* of the second coil body 220 comes into surface contact with a top surface 120*b* of the lower primary substrate 120, and the secondary coil element 200 is inserted in the receiving space S1 formed between the upper and lower primary substrates 110 and 120. Therefore, a coupling force between the primary coil element and the secondary coil element is increased.

In the transformer according to the second embodiment of the present invention, a first coupling portion 211*c* is bent in the U-shape in such a way that one end of a first coil pattern 211*b* is downwardly bent, and then is rearwardly bent, and a second coupling portion 221*c* is bent in the U-shape in such a way that one end of a second coil pattern 221*b* is upwardly bent, and then is rearwardly bent.

More specifically, the first coupling portion 211*c* is bent in the U-shape in such a way that one end of the first coil pattern 211*b* is downwardly bent in a U-shape, and then is rearwardly bent in a diagonal direction, and the second coupling portion 221*c* is bent in the U-shape in such a way that one end of the second coil pattern 221*b* is upwardly bent, and then is rearwardly bent in a straight line, so that the first coupling portion 211*c* and the second coupling portion 221*c* are disposed so as not to overlap with each other.

Therefore, it is possible to manufacture the first coupling portion 211*c* and the second coupling portion 221*c* so as not to overlap with each other even in a narrow area.

In the case of the second embodiment in which the secondary coil element 200 is interposed between the upper and lower primary substrates 110 and 120, the thickness of the product can be decreased by bending the first and second coupling portions 211*c* and 221*c* while the first and second coupling portions 211*c* and 221*c* are disposed so as not to overlap with each other.

The transformer includes secondary terminal pins P2 which are electrically connected to first and second terminals 211*a* and 221*a*, respectively, and also are connected to a main printed circuit board (not illustrated) of a finished product (e.g., a charger or an adaptor) onto which the transformer is mounted.

The first and second coil bodies 210 and 220 may be electrically connected to each other in series, as illustrated in the drawings. In the case of the series connection, a bridge may be provided.

The transformer may further include a bridge for electrically connecting first and second coil pattern portions 211*b* and 221*b*, and the first and second coil bodies 210 and 220 are electrically connected to each other by the bridge.

Although the embodiment illustrates the configuration in which the first and second coil bodies 210 and 220 are electrically connected to each other by the bridge, the present invention is not limited thereto. Of course, the case where the first and second coil bodies 210 and 220 may be electrically connected to each other in parallel, without connecting the first and second coil bodies 210 and 220, belongs to the technical scope of the present invention.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A transformer comprising:

an upper primary substrate (110);

lower primary substrate (120); and a secondary coil element (200) of a planar shape to produce an induced current by a current applied to the upper primary substrate (110) and the lower primary substrate (120), wherein the lower primary substrate (120) is positioned below the upper primary substrate (110), and is spaced apart from each other to form a receiving space (S1) between the upper and lower primary substrates (110 and 120), wherein, the secondary coil element (200) includes a first coil body (210) and a second coil body (220) disposed below the first coil body (210) and spaced apart from the first coil body (210), wherein any one of the first coil body (210) and the second coil body (220) of the secondary coil element (200) is inserted into the receiving space (S1), and the upper and lower primary substrates (110 and 120) and the secondary coil element (200) are alternatively arranged in a vertical direction, wherein the first coil body (210) includes: a first coil (211) having a first coil pattern portion (211*b*) which is formed in a shape of a planar spiral pattern, a first coupling portion (211*c*) which is formed in a U-shape by bending one end of the first coil pattern portion (211*b*) and then bending the end in a rearward direction, and a first terminal (211*a*) formed at the end of the first coupling portion (211*c*); and a first insulation member (212) having a first center opening (210*a*) formed at a center and made of a synthetic resin to house the first coil (211) therein, except for the first terminal (211*a*), wherein the second coil body (220) includes: a second coil (221) having a second coil pattern portion (221*b*) which is formed in a shape of a planar spiral pattern, a second coupling portion (221*c*) which is formed in a U-shape by bending one end of the second coil pattern portion (221*b*) and then bending the end in a rearward direction, and a second terminal (221*a*) formed at one end of the second coupling portion (221*c*); and a second insulation member (222) having a second center opening (220*a*) formed at a center and made of a synthetic resin to house the second coil (221) therein, except for the second terminal (221*a*), wherein the first coupling portion 211*c* is bent in the U-shape in such a way that one end of the first coil pattern 211*b* is downwardly bent, and then is rearwardly bent, and the second coupling portion 221*c* is bent in the U-shape in such a way that one end of the second coil pattern 221*b* is upwardly bent, and then is rearwardly bent, wherein the first coupling portion 211*c* and the second coupling portion 221*c* which are bent in a rearward direction are bent in the U-shape so as not to overlap with each other, and wherein a top surface 210*b* and a bottom surface 220*c* of the secondary coil element 200 are formed in a flat shape with no protrusion.

2. The transformer according to claim 1, wherein the upper primary substrate (110) and the lower primary substrate (120) are connected in series with each other.

3. The transformer according to claim 2, wherein the upper primary substrate (110) and the lower primary substrate (120) are electrically connected in series with each other by conductive metallic coupling pins (130) which are coupled to a via terminal (Ta) of the upper primary substrate (110) and a via terminal (Tb) of the lower primary substrate (120).

4. The transformer according to claim 1, wherein the lower primary substrate (120) is positioned below the upper primary substrate (110), and is spaced apart from each other to form a receiving space (S1) between the upper and lower primary substrates (110 and 120), the secondary coil element (200) includes a first coil body (210) and a second coil body (220) spaced apart from the first coil body (210), and any one of the first coil body (210) and the second coil body (220) of the secondary coil element (200) is inserted into the receiving space (S1), and the upper and lower primary substrates (110 and 120) and the secondary coil element (200) are alternatively arranged in a vertical direction.

5. The transformer according to claim 1, wherein the lower primary substrate (120) is positioned below the upper primary substrate (110), and is spaced apart from each other to form a receiving space (S1) between the upper and lower primary substrates (110 and 120), and the secondary coil element (200) is inserted into the receiving space (S1) formed between the upper and lower primary substrates (110 and 120).

6. The transformer according to claim 5, wherein the secondary coil element (200) includes secondary coils (211 and 221) of a conductive material which are formed in a spiral pattern, and insulation members (212 and 222) having center openings (210*a* and 220*a*) at a center thereof and made of a synthetic resin to house the secondary coils (211 and 221) therein, and a top surface (210*b*) of the secondary coil element (200) comes into contact with the upper primary substrate (110), and a bottom surface (220*c*) of the secondary coil element (200) comes into contact with the lower primary substrate (120), so that the secondary coil element (200) is inserted in the receiving space (S1) formed between the upper and lower primary substrates (110 and 120).

7. The transformer according to claim 6, wherein the secondary coils (211 and 221) include coil pattern portions (211*b* and 221*b*) which are formed in a shape of a planar spiral pattern, coupling portions (211*c* and 221*c*) which are bent in a U-shape from each end of the coil pattern portions (211*b* and 221*b*), and terminals (211*a* and 221*a*) which are formed at each end of the coupling portions (211*c* and 221*c*), the coupling portions (211*c* and 221*c*) are inwardly bent, the top surface (210*b*) and the bottom surface (220*c*) of the secondary coil element (200) are formed in a flat shape with no protrusion, the top surface (210*b*) of the secondary coil element (200) comes into surface contact with a bottom surface (110*c*) of the upper primary substrate (110), and the bottom surface (220*c*) of the secondary coil element (200) comes into surface contact with a top surface (120*b*) of the lower primary substrate (120).

8. The transformer according to claim 7, wherein the secondary coil element (200) includes a first coil body (210) and a second coil body (220) disposed below the first coil body (210) and spaced apart from the first coil body;

the first coil body (210) has a first coil (211) having a first coil pattern portion (211*b*) which is formed in a shape of a planar spiral pattern, a first coupling portion (211*c*) which is formed in a U-shape by bending one end of the first coil pattern portion (211*b*) and then bending the end in a rearward direction, and a first terminal (211*a*) formed at the end of the first coupling portion (211*c*), and a first insulation member (212) having a first center opening (210*a*) formed at a center and made of a synthetic resin to house the first coil (211) therein, except for the first terminal (211*a*); and the second coil body (220) has a second coil (221) having a second coil pattern portion (221*b*) which is formed in a shape of a planar spiral pattern, a second coupling portion (221*c*) which is formed in a U-shape by bending one end of the second coil pattern portion (221*b*) and then bending the end in a rearward direction, and a second terminal (221*a*) formed at one end of the second coupling portion (221*c*), and a second insulation member (212) having a second center opening (220*a*) formed at a center and made of a synthetic resin to house the second coil (221) therein, except for the second terminal (221*a*).

* * * * *